US012181156B1

(12) United States Patent
Hayes

(10) Patent No.: US 12,181,156 B1
(45) Date of Patent: Dec. 31, 2024

(54) OVEN DOOR NON-GLASS REPLACEMENT

(71) Applicant: Wanda Hayes, Philadelphia, PA (US)

(72) Inventor: Wanda Hayes, Philadelphia, PA (US)

( * ) Notice: Subject to any disclaimer, the term of this patent is extended or adjusted under 35 U.S.C. 154(b) by 451 days.

(21) Appl. No.: 17/751,840

(22) Filed: May 24, 2022

(51) Int. Cl.
*F24C 15/04* (2006.01)

(52) U.S. Cl.
CPC ..... *F24C 15/04* (2013.01); *F24C 15/045* (2013.01)

(58) Field of Classification Search
CPC ..... F24C 15/04; F24C 15/045
See application file for complete search history.

(56) References Cited

U.S. PATENT DOCUMENTS 2,582,458 A * 1/1952 Rose ..... F24C 15/04 52/786.13
3,070,085 A * 12/1962 Mills ..... F24C 15/04 126/200
3,847,199 A 11/1974 Meier et al.
4,033,321 A * 7/1977 Krebs ..... F24C 15/045 126/200
5,029,571 A * 7/1991 Trosin ..... F24C 15/04 52/786.13
5,799,647 A * 9/1998 Mills ..... F24C 15/04 126/200
8,716,631 B2 5/2014 Venezia et al.
9,347,674 B2 5/2016 Edwards et al.
9,429,329 B2 8/2016 DeLozier et al.
9,671,114 B2 6/2017 Braden et al.
9,677,775 B2 6/2017 Phillips et al.
10,208,962 B2 2/2019 Philip et al.
10,234,146 B2 3/2019 Phillips et al.
10,718,529 B2 7/2020 Phillips et al.
2015/0211745 A1* 7/2015 Stone ..... E05D 7/10 126/200

* cited by examiner

*Primary Examiner* — Alfred Basichas
(74) *Attorney, Agent, or Firm* — Cramer Patent & Design PLLC; Aaron R. Cramer

(57) ABSTRACT

The non-glass oven window replacement may comprise a window replacement insert that may replace a broken window on an oven door such that the oven door may thermally seal the oven without glass. The window replacement insert may comprise an exterior insert half and an interior insert half that may couple to the oven door from opposite sides of the oven door such that a window aperture is filled by the window replacement insert. The window replacement insert may be thermally insulated to reduce the transfer of heat from the inside of the oven to the outside of the oven. In some embodiments, the window replacement insert may comprise one or more doors that may be adapted for a user to open in order to see into the oven.

20 Claims, 9 Drawing Sheets

OVEN DOOR NON-GLASS REPLACEMENT

RELATED APPLICATIONS

None.

FIELD OF THE INVENTION

The present invention relates to an oven door replacement and more specifically to an oven door replacement which is non-glass.

BACKGROUND OF THE INVENTION

Many of us have had the unfortunate incident of having a glass panel on an oven door explode during use of the oven. Whether as a result of age, binding in the door frame, stress, or the like, it is a frightening experience. However, after the glass is cleaned up, and the food inside discarded, one is still left with an expensive repair bill. Even then, there is no guarantee that the replacement glass panel will not shatter in the same method days, weeks, or even years later.

However, nothing short of replacing the entire oven or range with a different model without a glass panel will permanently fix the problem. Accordingly, there exists a need for a means by which repair of a shattered glass panel in an oven door can be accomplished without the current disadvantages as described above. The development of the oven door non-glass replacement fulfills this need.

SUMMARY OF THE INVENTION

The principles of the present invention provide for a non-glass oven window replacement may have a window replacement insert adapted to replace a broken window on an oven having an oven door, a plurality of exterior coupling apertures disposed on each corner of the exterior core on a side of the exterior core that is opposite the exterior panel, and a plurality of interior coupling apertures disposed on the interior insert half align with the plurality of exterior coupling apertures on the exterior insert half such that a plurality of couplers are screwed into the plurality of interior coupling apertures that pass through an interior insert half and into the plurality of exterior coupling apertures on the exterior insert half if the interior insert half and the exterior insert half are in position within the window aperture. The couplers are tightened such that the couplers pull the interior insert half and the exterior insert half together with the oven door are sandwiched between the interior insert half and the exterior insert half. The window replacement insert includes an exterior insert half and an interior insert half that is adapted to couple to the oven door. The exterior insert half includes an exterior panel and an exterior core, and the interior insert half includes an interior panel and an interior core introduced into the window aperture from the interior of the oven.

The window replacement insert may couple from opposite sides of the oven door such that a window aperture is filled by the window replacement insert. The window replacement insert may be thermally insulated to reduce a transfer of heat from inside of the oven to outside of the oven. The window replacement insert may include 1 or more doors that are adapted for a user to open in order to see into the oven. The broken window may be a single pane of glass. The broken window may be a double pane of glass. The broken window may be an outer pane of glass. The oven door may thermally seal the oven without glass. The exterior insert half may be introduced into the window aperture from an exterior of the oven. The exterior panel may be taller and wider than a height and a width of the window aperture in the oven door such that the exterior panel prevents the exterior insert half from passing through the window aperture. A height and a width of the exterior core may be smaller than the height and the width of the window aperture such that the exterior core may pass through the window aperture. The exterior core may be centered on the exterior panel and may be thicker than the exterior panel. The exterior core may extend into the window aperture no farther than one half of a thickness of the oven door such that there is no mechanical interference between the exterior insert half and the interior insert half. The interior core and the exterior core may be insulated to impede transfer of heat from within the oven. The interior core and/or the interior of the exterior core may be packed with fiberglass. The oven may reach up to 1000° F. during self-cleaning cycles. The exterior insert half and/or the interior insert half may be made of a metal selected from the group consisting of stainless steel, titanium, tungsten, nickel, and any alloy thereof, ceramic materials, composite materials, forms of carbon, or any combination of metals, ceramics, and composites. The exterior coupling apertures may be threaded. The exterior panel may be selected from the group consisting of aluminum, stainless steel, chrome, or painted. The couplers may be a plurality of screws or a plurality of bolts.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
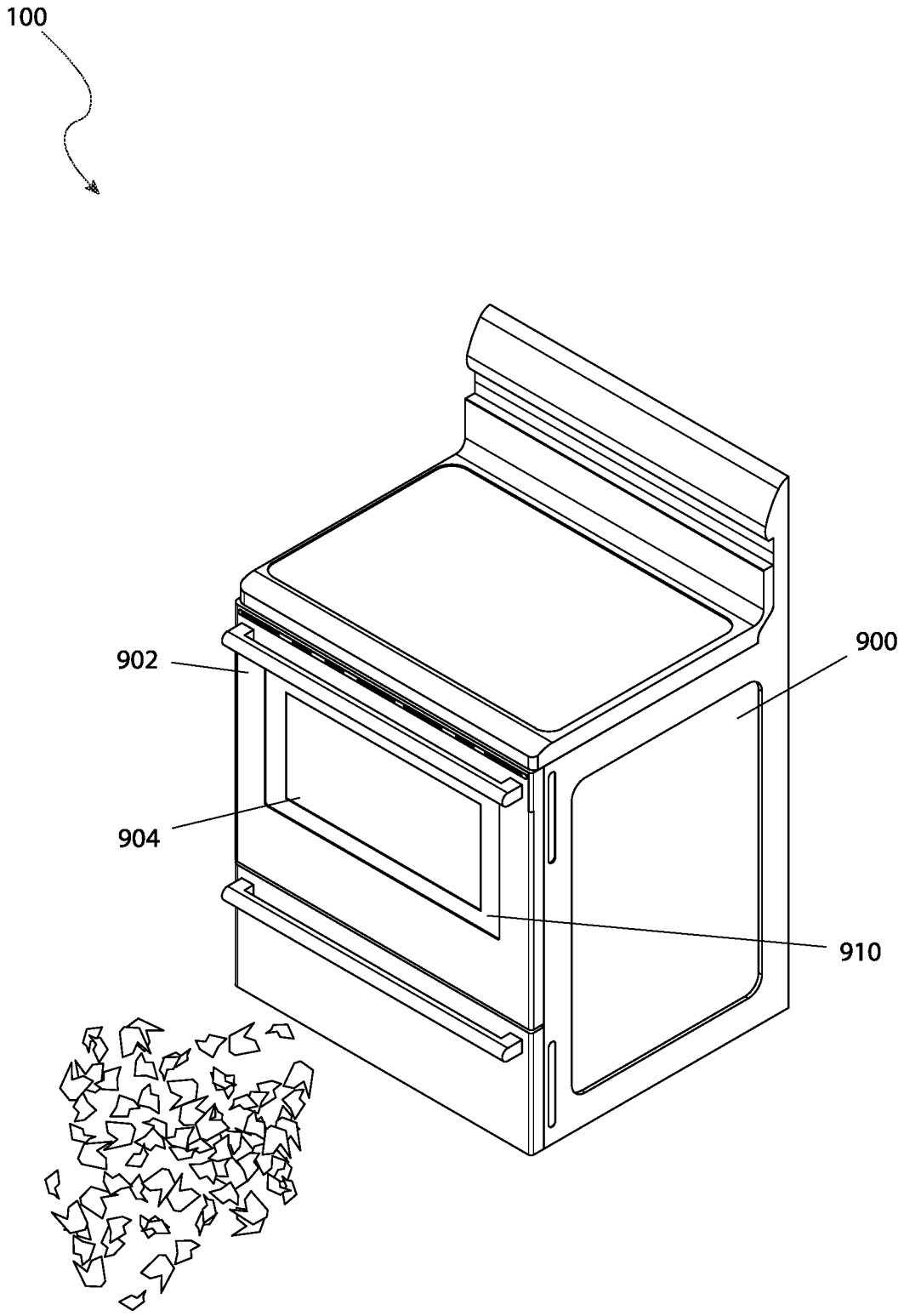
FIG. 1 is an isometric view of an oven comprising an oven door with a broken window, according to an embodiment of the present invention.
Figure 2:
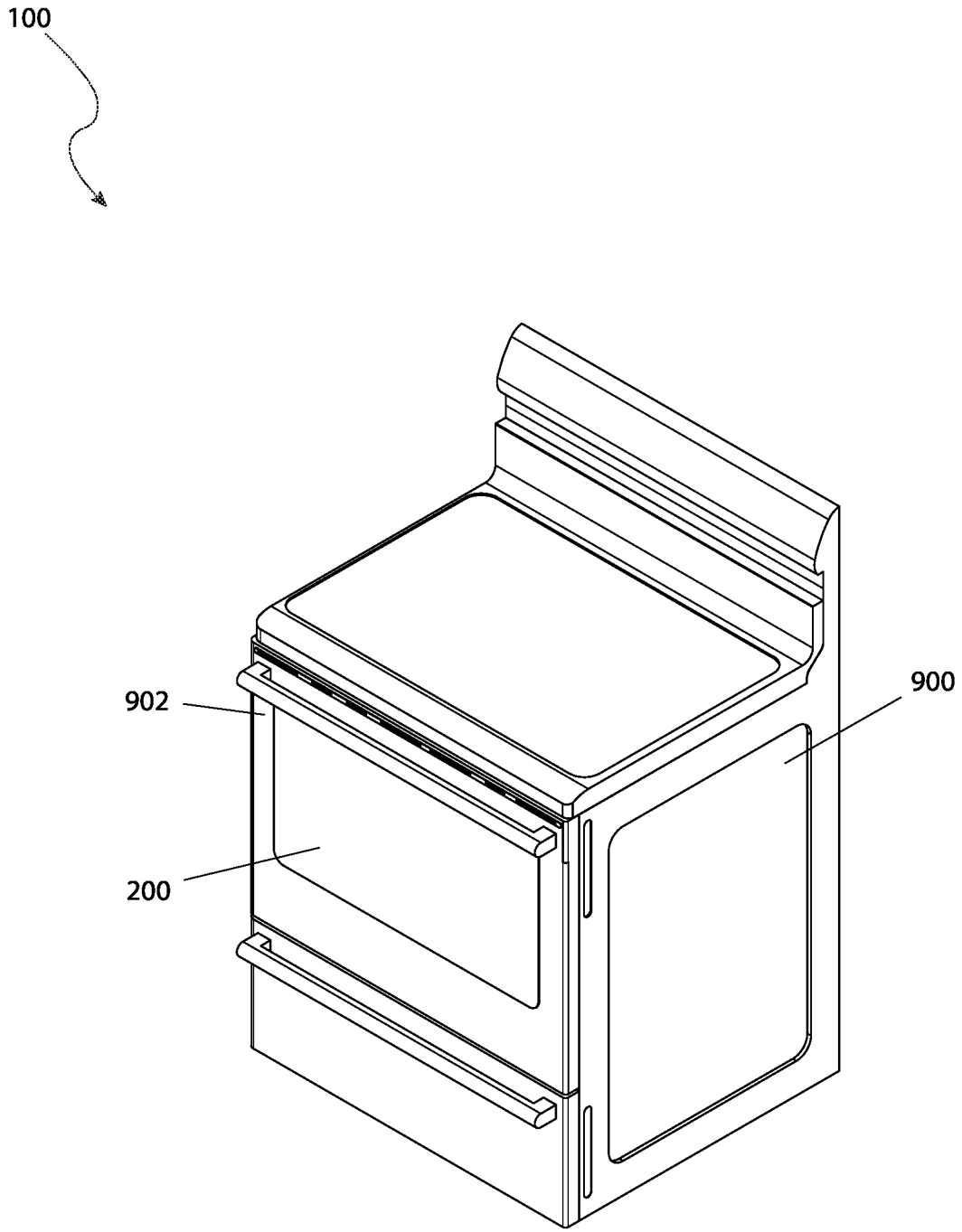
FIG. 2 is an isometric view of a non-glass oven window replacement, according to an embodiment of the present invention.
Figure 3:
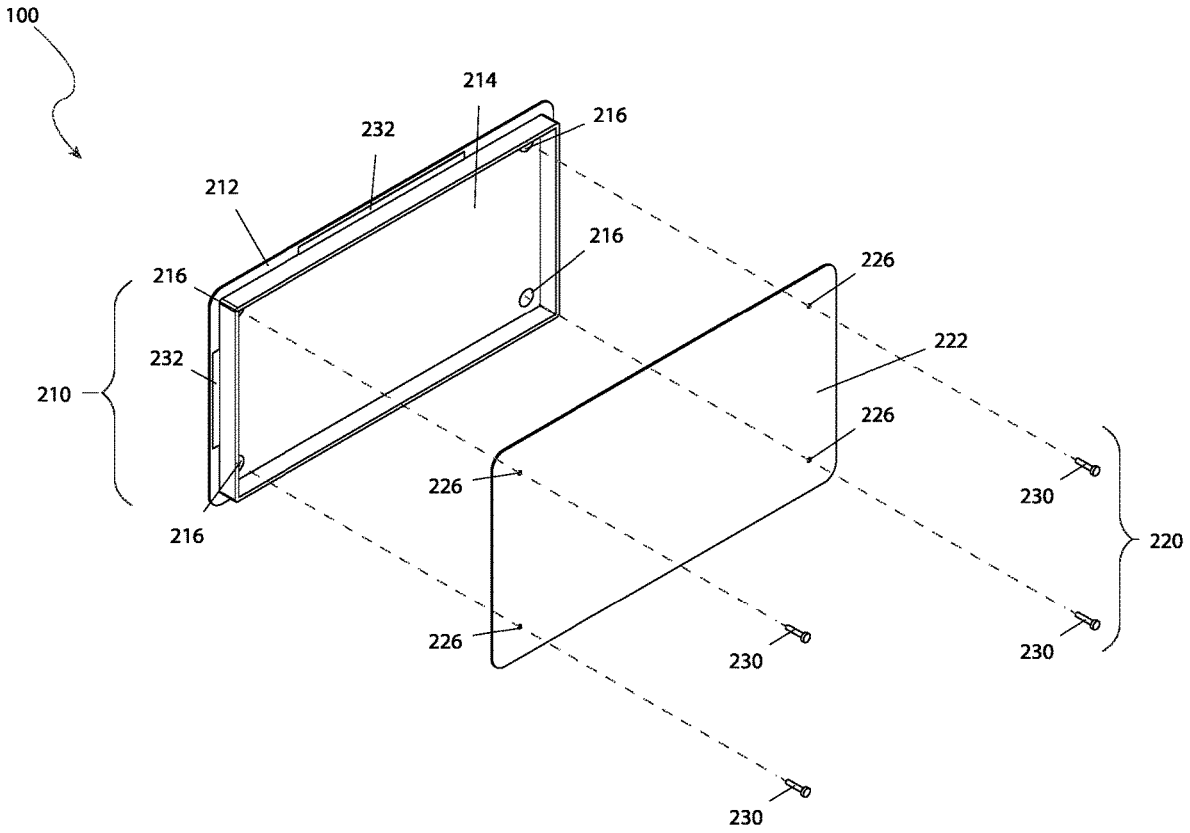
FIG. 3 is an exploded view of a non-glass oven window replacement, according to an embodiment of the present invention.
Figure 4:
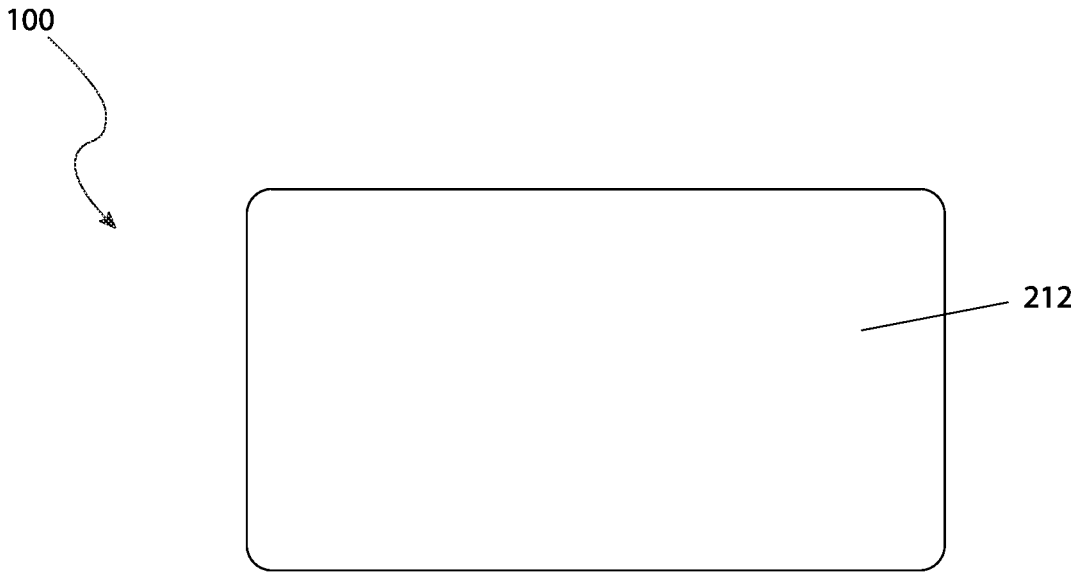
FIG. 4 is a front view of a non-glass oven window replacement, according to an embodiment of the present invention.
Figure 5:
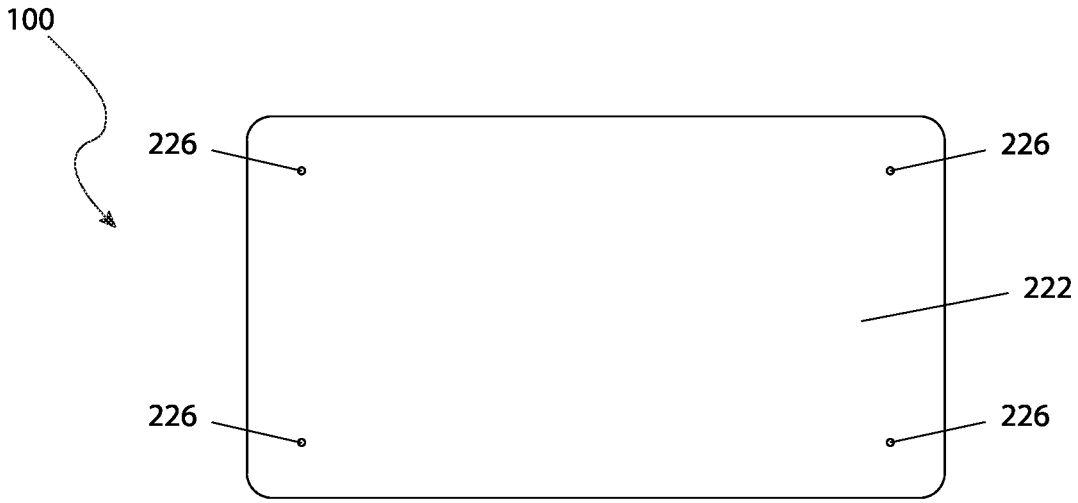
FIG. 5 is a rear view of a non-glass oven window replacement, according to an embodiment of the present invention.
Figure 6:
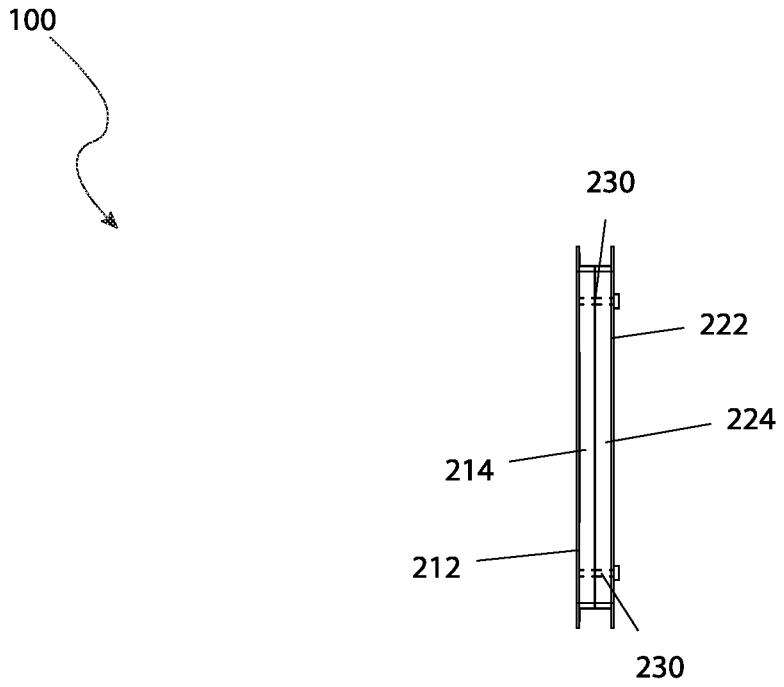
FIG. 6 is a side view of a non-glass oven window replacement, according to an embodiment of the present invention.
Figure 7:
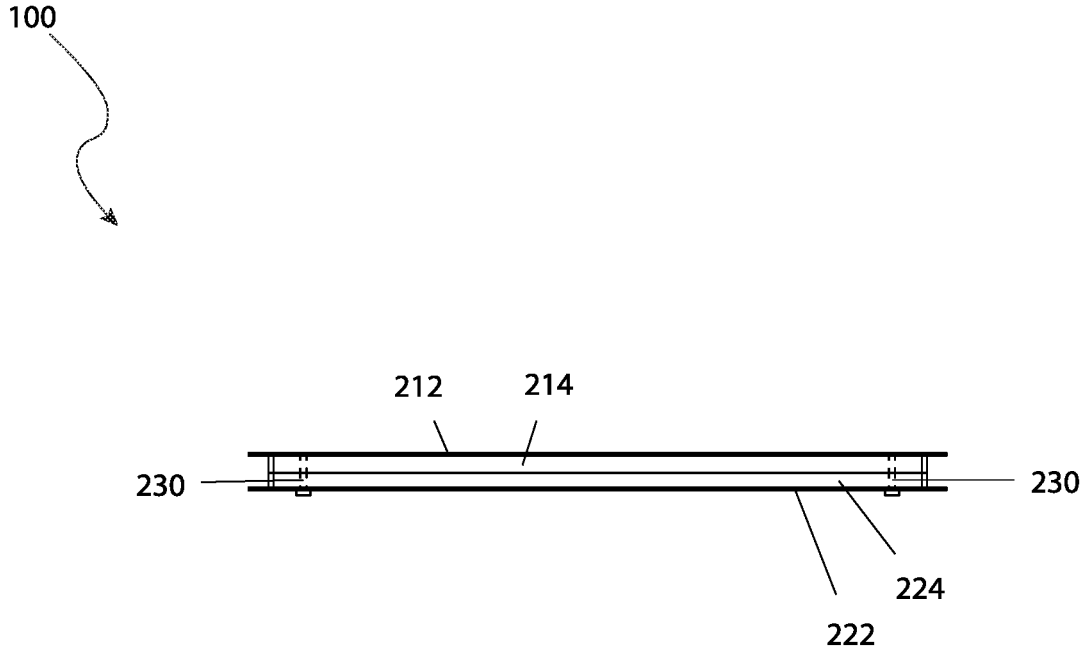
FIG. 7 is a top view of a non-glass oven window replacement, according to an embodiment of the present invention.
Figure 8:
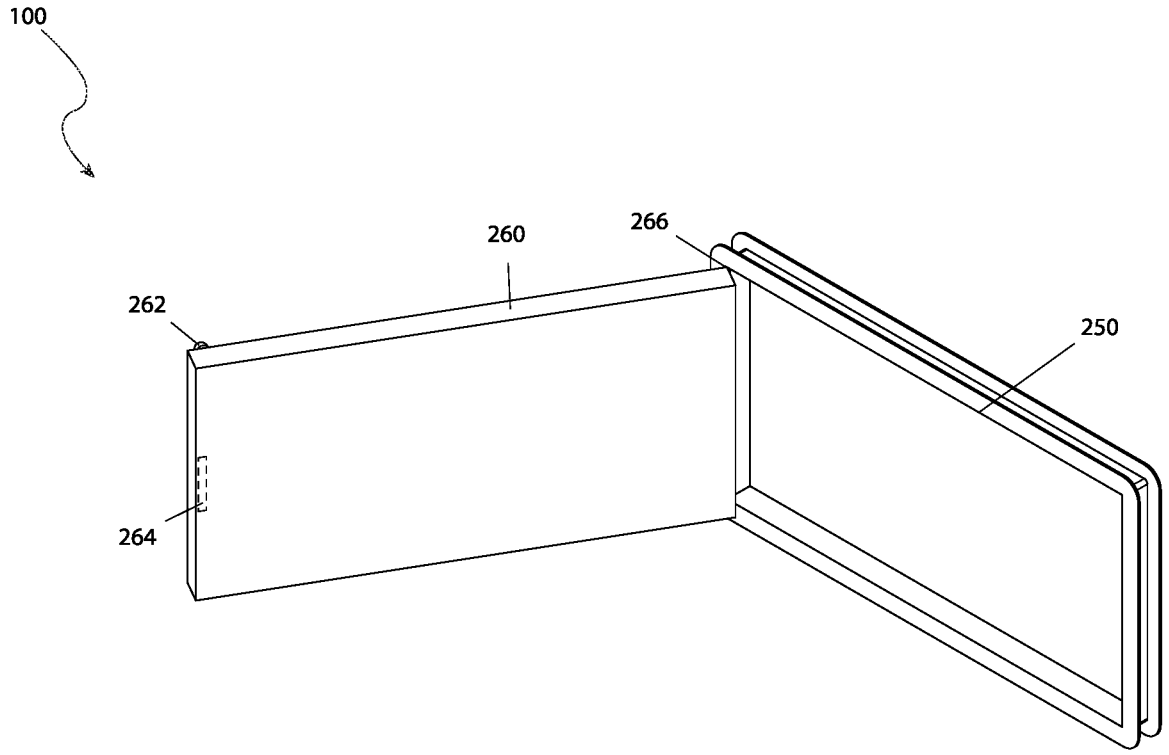
FIG. 8 is an isometric view of a non-glass oven window replacement, according to an embodiment of the present invention, illustrating a full door.
Figure 9:
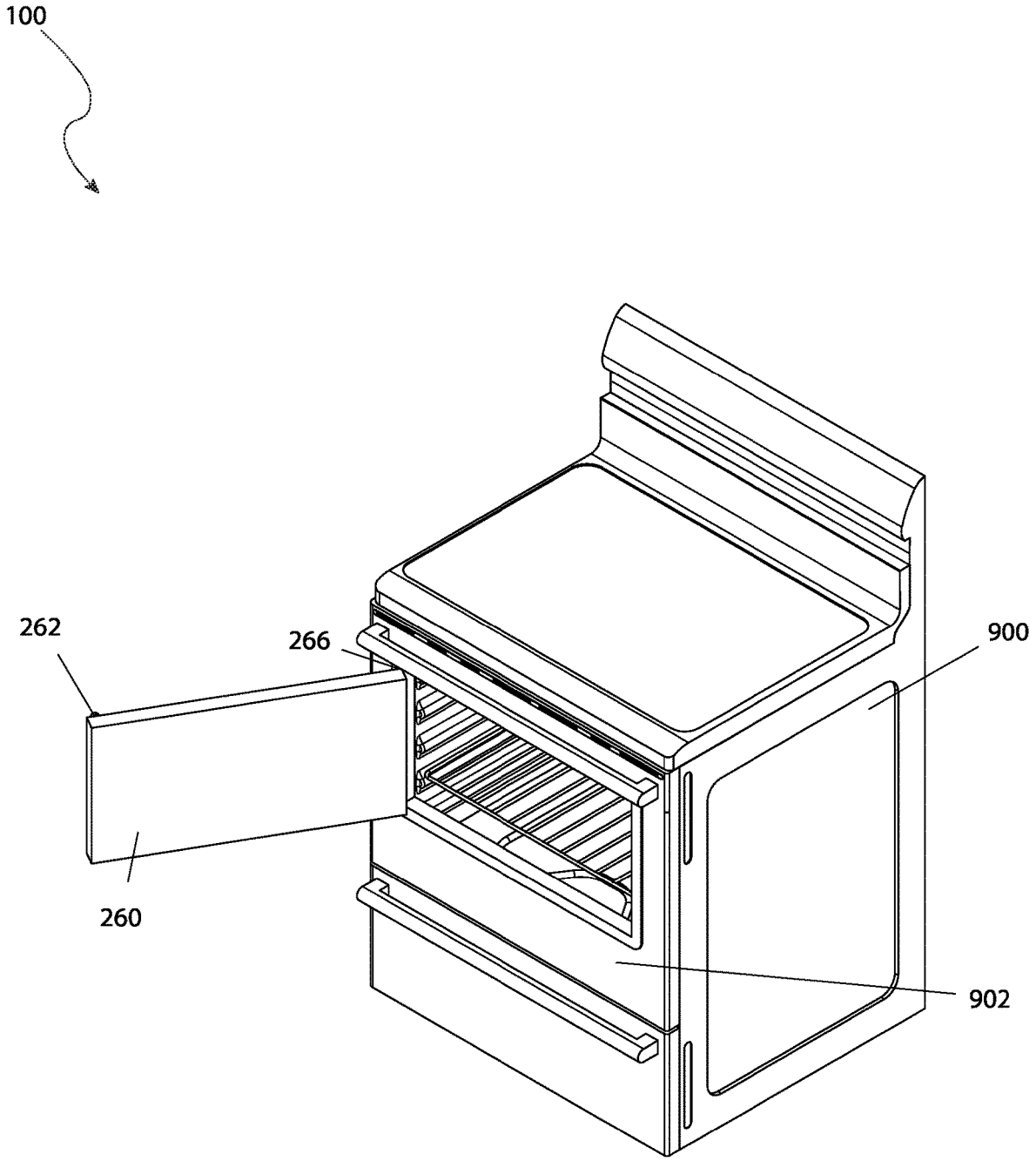
FIG. 9 is an in-use view of a non-glass oven window replacement, according to an embodiment of the present invention, illustrating a full door that opens to the side.
Figure 10:
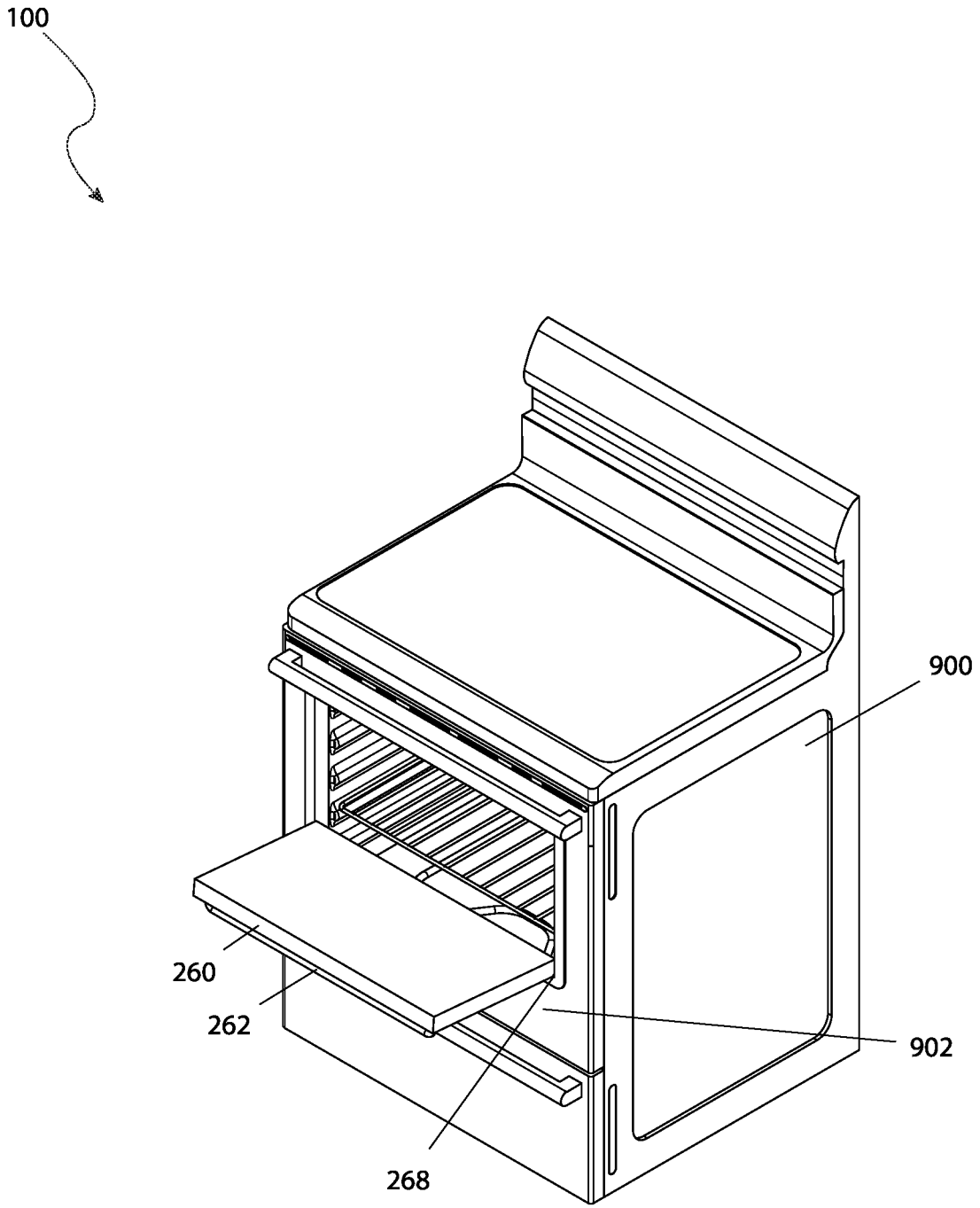
FIG. 10 is an in-use view of a non-glass oven window replacement, according to an embodiment of the present invention, illustrating a full door that opens down; and, FIG. 11 is an in-use view of a non-glass oven window replacement, according to an embodiment of the present invention, illustrating a first half door and a second half door.
Figure 11:
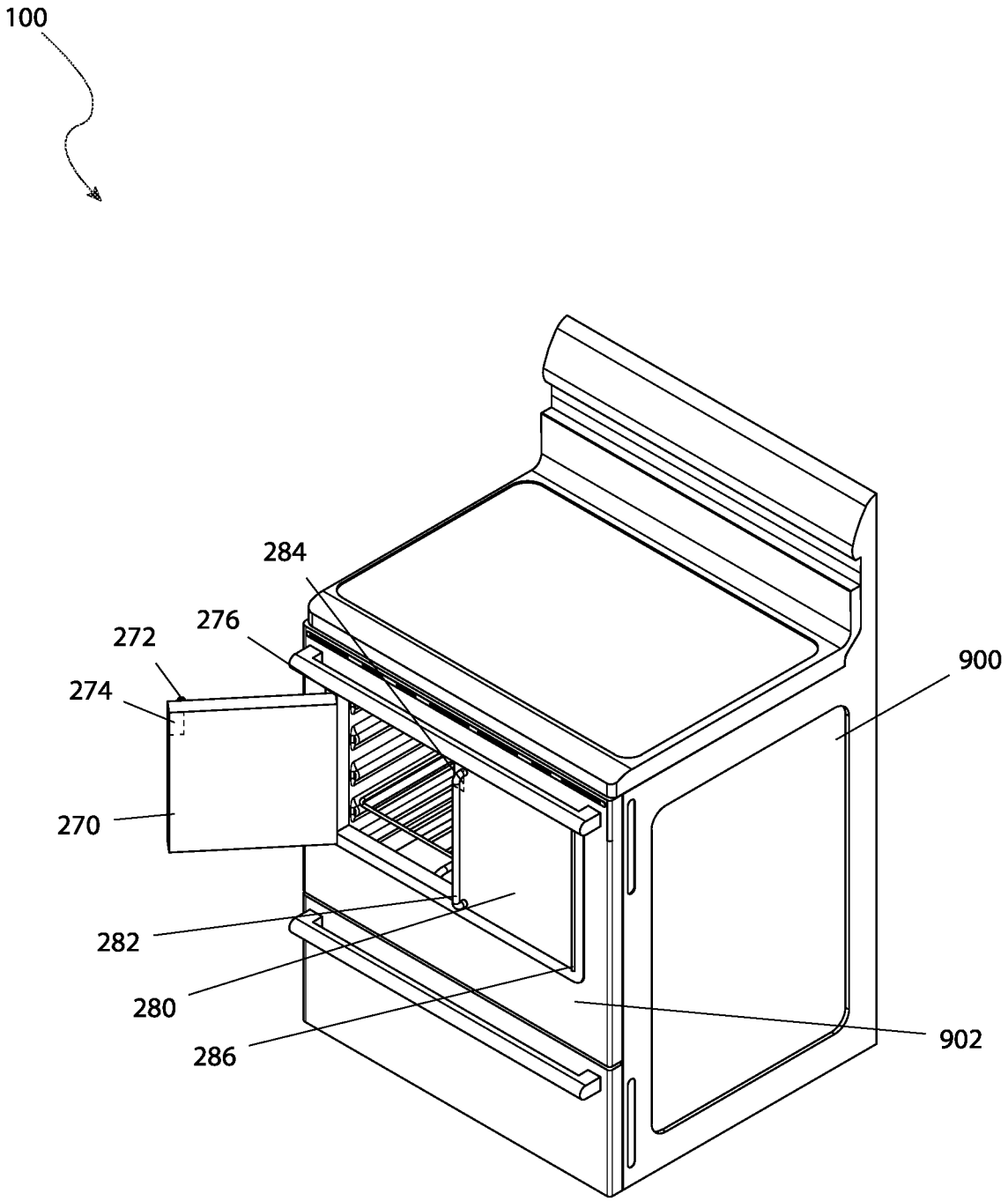

100 non-glass oven window replacement
200 window replacement insert
210 exterior insert half
212 exterior panel
214 exterior core
216 exterior coupling aperture
220 interior insert half
222 interior panel
224 interior core
226 interior coupling aperture
230 coupler
232 magnet
250 oven access aperture
260 full door
262 full door handle
264 full door latch
266 full door side hinge
268 full door bottom hinge
270 first half door
272 first half door handle
274 first half door latch
276 first half door hinge
280 second half door
282 second half door handle
284 second half door latch
286 second half door hinge
900 oven
902 oven door
904 broken window
910 window aperture

BACKGROUND OF THE INVENTION

An oven 900 may comprise an oven door 902 having a window 904. The window 904 may break and spread broken glass throughout the kitchen. As non-limiting examples, the broken window 904 may break because of thermal stresses created by repeated heating and cooling of the oven 900, mechanical stresses created by repeated opening and closing of the oven door 902 and/or vibration from other kitchen appliances, or a combination of these and other stresses. New glass may replace the broken glass to restore the broken window 904, however the new glass may also be susceptible to breakage. In fact, the new glass may be even more likely to break given that the quality of the new glass and the workmanship of the replacement may now become factors that affect stresses on the window 904.

DESCRIPTION OF THE INVENTION

The present invention is directed to a non-glass oven window replacement (herein described as the "invention") 100. The invention 100 may comprise a window replacement insert 200 that may replace a broken window 904 on an oven door 902 such that the oven door 902 may thermally seal the oven 900 without glass. Such a Broken window 904 can be a single pane of glass or a double pane of glass. The invention 100 is particularly suited for replacing a broken outer pane of glass. The window replacement insert 200 may comprise an exterior insert half 210 and an interior insert half 220 that may couple to the oven door 902 from opposite sides of the oven door 902 such that a window aperture 910 is filled by the window replacement insert 200. The window replacement insert 200 may be thermally insulated to reduce the transfer of heat from the inside of the oven 900 to the outside of the oven 900. In some embodiments, the window replacement insert 200 may comprise one (1) or more doors that may be adapted for a user to open in order to see into the oven 900.

The exterior insert half 210 may comprise an exterior panel 212 and an exterior core 214. The exterior insert half 210 may be introduced into the window aperture 910 from the exterior of the oven 900. The exterior panel 212 may be taller and wider than the height and width of the window aperture 910 in the oven door 902 such that the exterior panel 212 may prevent the exterior insert half 210 from passing through the window aperture 910. The exterior core 214 may be centered on the exterior panel 212 and may be thicker than the exterior panel 212. The height and width of the exterior core 214 may be smaller than the height and width of the window aperture 910 such that the exterior core 214 may pass through the window aperture 910. The exterior core 214 may extend into the window aperture 910 no farther than one half of the thickness of the oven door 902 such that there is no mechanical interference between the exterior insert half 210 and the interior insert half 220. A plurality of exterior coupling apertures 216 may be located in each corner of the exterior core 214 on the side of the exterior core 214 that is opposite the exterior panel 212. The plurality of exterior coupling apertures 216 may be threaded.

The front side of the exterior panel 212—the side that is opposite the exterior core 214—may be visible on the outside of the oven 900 and may therefore comprise a decorative finish. As non-limiting examples, the front of the exterior panel 212 may be aluminum, stainless steel, chrome, or painted.

The interior insert half 220 may comprise an interior panel 222 and an interior core 224. The interior insert half 220 may be introduced into the window aperture 910 from the interior of the oven 900. The interior panel 222 may be taller and wider than the height and width of the window aperture 910 in the oven door 902 such that the interior panel 222 may prevent the interior insert half 220 from passing through the window aperture 910. The interior core 224 may be centered on the interior panel 222 and may be thicker than the interior panel 222. The height and width of the interior core 224 may be smaller than the height and width of the window aperture 910 such that the interior core 224 may pass through the window aperture 910. The interior core 224 may extend into the window aperture 910 no farther than one half of the thickness of the oven door 902 such that there is no mechanical interference between the exterior insert half 210 and the interior insert half 220. A plurality of interior coupling apertures 226 may be located in each corner of the interior core 224 on the side of the interior core 224 that is opposite the interior panel 222. The plurality of interior coupling apertures 226 may be threaded. The plurality of interior coupling apertures 226 may extend all the way through the interior core 224 and through the interior panel 222 such that such that the plurality of interior coupling apertures 226 are accessible on both sides of the interior insert half 220.

The plurality of interior coupling apertures 226 on the interior insert half 220 may align with the plurality of exterior coupling apertures 216 on the exterior insert half 210 such that a plurality of couplers 230 screwed into the plurality of interior coupling apertures 226 may pass through the interior insert half 220 and into the plurality of exterior coupling apertures 216 on the exterior insert half 210 if the interior insert half 220 and the exterior insert half 210 are in position within the window aperture 910. The plurality of couplers 230 may be tightened such that the plurality of couplers 230 pull the interior insert half 220 and the exterior insert half 210 together with the oven door 902 sandwiched between the interior insert half 220 and the exterior insert half 210. As non-limiting examples, the plurality of couplers 230 may be screws or bolts.

The interior core 224 and the exterior core 214 may be insulated to impede the transfer of heat from within the oven 900. As a non-limiting example, the interior of the interior core 224 and/or the interior of the exterior core 214 may be packed with fiberglass.

In some embodiments, magnets 232 located on the exterior panel 212 and/or on the interior panel 222 may be operable to hold the exterior panel 212 and/or the interior panel 222 to the oven door 902 in place of or in addition to the plurality of couplers 230.

The exterior insert half 210 and/or the interior insert half 220 may be made of materials that may withstand the temperatures inside of the oven 900. By way of example and not of limitation, the temperature inside the oven 900 may reach up to one thousand degrees Fahrenheit (1000° F.) during self-cleaning cycles. As non-limiting examples, the exterior insert half 210 and/or the interior insert half 220 may be made of metals such as stainless steel, titanium, tungsten, nickel, and any alloy thereof, ceramic materials, composite materials, especially composites comprising ceramic materials or forms of carbon, or any combination of metals, ceramics, and composites.

In some embodiments, one (1) or more doors that are hingedly coupled to the window replacement insert 200 may open and close so that the interior of the oven 900 may be periodically viewed during use. An oven access aperture 250 extending through both the exterior insert half 210 and the interior insert half 220 may provide access for viewing when the one (1) or more doors are open. The oven access aperture 250 may be blocked by the one (1) or more doors when the one (1) or more doors are closed.

In some embodiments, the one (1) or more doors may comprise a full door 260 that may be hingedly coupled to the exterior insert half 210. The full door 260 may block the oven access aperture 250 in its entirety when the full door 260 is closed. The full door 260 may be opened to view the interior of the oven 900. The full door 260 may comprise a full door handle 262 that may be adapted for the user to grasp in order to open and close the full door 260. The full door 260 may further comprise a full door latch 264 to hold the full door 260 closed. The full door 260 may be hingedly coupled via a full door side hinge 266 such that the full door 260 swings to the side when opened. Alternatively, the full door 260 may be hingedly coupled via a full door bottom hinge 268 such that the full door 260 swings down when opened.

In some embodiments, the one (1) or more doors may comprise half doors. The half doors may block the oven access aperture 250 in its entirety when the half doors are closed. The half doors may comprise a first half door 270 and a second half door 280 which may be opened individually or simultaneously to view the interior of the oven 900.

The first half door 270 may comprise a first half door handle 272 that may be adapted for the user to grasp in order to open and close the first half door 270. The first half door 270 may further comprise a first half door latch 274 to hold the first half door 270 closed. The first half door 270 may be hingedly coupled via a first half door hinge 276 such that the first half door 270 swings to the side when opened.

The second half door 280 may comprise a second half door handle 282 that may be adapted for the user to grasp in order to open and close the second half door 280. The second half door 280 may further comprise a second half door latch 284 to hold the second half door 280 closed. The second half door 280 may be hingedly coupled via a second half door hinge 286 such that the second half door 280 swings to the side when opened.

In use, a broken window 904 or the outer broken pane of glass may be removed from the oven door 902 and the window replacement insert 200 may be installed by positioning the exterior insert half 210 and the interior insert half 220 on opposites sides of the oven door 902 and coupling them using the plurality of couplers 230. If present, the one (1) or more doors may be closed for normal use of the oven 900 and may be opened to view the interior of the oven 900.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A non-glass oven window replacement, comprising:

a window replacement insert adapted to replace a broken window on an oven having an oven door, the window replacement insert includes an exterior insert half and an interior insert half that is adapted to couple to the oven door, the exterior insert half includes an exterior panel and an exterior core and the interior insert half includes an interior panel and an interior core introduced into the window aperture from the interior of the oven;

a plurality of exterior coupling apertures disposed on each corner of the exterior core on a side of the exterior core that is opposite the exterior panel; and a plurality of interior coupling apertures disposed on the interior insert half align with the plurality of exterior coupling apertures on the exterior insert half such that a plurality of couplers are screwed into the plurality of interior coupling apertures that pass through an interior insert half and into the plurality of exterior coupling apertures on the exterior insert half if the interior insert half and the exterior insert half are in position within the window aperture, the couplers are tightened such that the couplers pull the interior insert half and the exterior insert half together with the oven door are sandwiched between the interior insert half and the exterior insert half.

2. The non-glass oven window replacement, according to claim 1, wherein the window replacement insert couples from opposite sides of the oven door such that a window aperture is filled by the window replacement insert.

3. The non-glass oven window replacement, according to claim 1, wherein the window replacement insert is thermally insulated to reduce a transfer of heat from inside of the oven to outside of the oven.

4. The non-glass oven window replacement, according to claim 1, wherein the window replacement insert includes 1 or more doors that are adapted for a user to open in order to see into the oven.

5. The non-glass oven window replacement, according to claim 1, wherein the broken window is a single pane of glass.

6. The non-glass oven window replacement, according to claim 1, wherein the broken window is a double pane of glass.

7. The non-glass oven window replacement, according to claim 1, wherein the broken window is an outer pane of glass.

8. The non-glass oven window replacement, according to claim 1, wherein the oven door thermally seals the oven without glass.

9. The non-glass oven window replacement, according to claim 1, wherein the exterior insert half is introduced into the window aperture from an exterior of the oven.

10. The non-glass oven window replacement, according to claim 1, wherein the exterior panel is taller and wider than a height and a width of the window aperture in the oven door such that the exterior panel prevents the exterior insert half from passing through the window aperture.

11. The non-glass oven window replacement, according to claim 1, wherein a height and a width of the exterior core is smaller than the height and the width of the window aperture such that the exterior core passes through the window aperture.

12. The non-glass oven window replacement, according to claim 1, wherein the exterior core is centered on the exterior panel and is thicker than the exterior panel.

13. The non-glass oven window replacement, according to claim 1, wherein the exterior core extends into the window aperture no farther than one half of a thickness of the oven door such that there is no mechanical interference between the exterior insert half and the interior insert half.

14. The non-glass oven window replacement, according to claim 1, wherein the interior core and the exterior core is insulated to impede transfer of heat from within the oven.

15. The non-glass oven window replacement, according to claim 14, wherein the interior core and/or the interior of the exterior core is packed with fiberglass.

16. The non-glass oven window replacement, according to claim 1, wherein the oven reaches up to 1000° F. during self-cleaning cycles.

17. The non-glass oven window replacement, according to claim 1, wherein the exterior insert half and/or the interior insert half are made of a metal selected from the group consisting of stainless steel, titanium, tungsten, nickel, and any alloy thereof, ceramic materials, composite materials, forms of carbon, or any combination of metals, ceramics, and composites.

18. The non-glass oven window replacement, according to claim 1, wherein the exterior coupling apertures are threaded.

19. The non-glass oven window replacement, according to claim 1, wherein the exterior panel is selected from the group consisting of aluminum, stainless steel, chrome, or painted.

20. The non-glass oven window replacement, according to claim 1, wherein the couplers are a plurality of screws or a plurality of bolts.

* * * * *